United States Patent [19]

Mills et al.

[11] Patent Number: 4,532,974

[45] Date of Patent: Aug. 6, 1985

[54] COMPONENT CASTING

[75] Inventors: David Mills; Anthony T. Lindahl; Alan D. Kington, all of Bristol, England

[73] Assignee: Rolls-Royce Limited, London, England

[21] Appl. No.: 393,549

[22] Filed: Jun. 30, 1982

[30] Foreign Application Priority Data

Jul. 3, 1981 [GB] United Kingdom ..... 8120598

[51] Int. Cl.[3] ..... B22D 29/00

[52] U.S. Cl. ..... 164/132; 164/367; 164/368; 164/369; 164/411

[58] Field of Search ..... 164/30–32, 164/28, 132, 122.1, 122.2, 369, 397, 411, 365, 366, 367, 368

[56] References Cited

U.S. PATENT DOCUMENTS 3,945,429 3/1976 Wahlquist ..... 164/369

FOREIGN PATENT DOCUMENTS 202619 9/1955 Australia .

1230187 4/1971 United Kingdom .

1549819 8/1979 United Kingdom ..... 164/369

2019756A 11/1979 United Kingdom .

2080165A 2/1982 United Kingdom .

*Primary Examiner*—Kuang Y. Lin

*Attorney, Agent, or Firm*—Parkhurst & Oliff

[57] ABSTRACT

A reinforced tubular core for casting gas turbine engine blades with cooling air passages therein is disclosed. A method of casting is also disclosed in which the blades are directionally solidified to produce columnar grained or single crystal blades and in which non-linear passages can be produced. The problem in producing such articles is that the moulds and cores used in the casting process are held at temperatures in excess of 1500° for long periods and presently used silica cores deform during the process. Stronger cores of alumina or silicon nitride cannot be easily bent were believed to be non-leachable from the casting. The present invention provides a core having a tubular silica sheath with a solid alumina rod inside it for support. The sheath can be bent and the straight alumina rods can be inserted from opposite ends of the sheath.

11 Claims, 4 Drawing Figures

COMPONENT CASTING

BACKGROUND OF THE INVENTION

This invention relates to the casting of components and in particular to such casting using cores to define passages in the components, e.g. cooling air passages in cast blades for use in gas turbine engines. The invention includes a method of casting components.

In casting such blades it is conventional to use cores of silica, this material being of moderate rigidity and refractoriness but easy leachability. Because of the limited rigidity and refractoriness of silica, it is often necessary, especially in the case of a long core or a core of complex shape, to support the core so as to prevent it from being deflected by the inflow of molten blade material in filling the mold or to prevent it from being distorted at high temperatures.

The problem of core distortion is particularly acute in the casting of directionally solidified and single crystal components wherein the mold and core are heated to a higher temperature (typically in excess of 1500° C.) than in conventional casting, and are maintained at the higher temperature for a longer period of time.

It has been proposed in the past to make the core of tubular form and provide an inner re-inforcement.

For example in UK Pat. No. 1,514,819 a tubular core is lined by a re-inforcing material of greater strength bonded to the inner surface of the core. Such re-inforced cores have been found frequently to break during the casting process leading to an ill-defined passage in the cast component.

It is also known, for example, from UK Patent application No. 2,019,756 to put metal rods inside a ceramic sheath to act as a re-inforcement. The metal disclosed in this Patent application is copper. Clearly such a re-inforced core would be of no use in the casting of superalloy gas turbine engine blades in directionally solidified form, when the casting temperature of the mold is in excess of 1500° C.

Another problem in the casting of turbine blades for gas turbine engines is that the cores are often required to be formed with bends therein, due to the misalignment between parts of the blade aerofoil which require cooling air passages therein, and the root of the blade through which the air is supplied to the aerofoil. This requirement calls for a core material which is deformable enough to be capable of being bent to the appropriate shape but which is rigid enough not to distort at the high temperatures required during its use. However, at temperatures in excess of 1500° C. ceramic cores must be used, but these two requirements are incompatible with present ceramic core materials. This is because in order to provide the strength, the available core materials such as alumina, or silicon nitride are too rigid to be bent without great difficulty, and are considered to be non-leachable from the castings, or only leachable with great difficulty. On the other hand, the leachable and more easily deformable materials such as silica or the glass ceramics are unable to withstand the temperatures required, particularly for casting directionally solidified components, for the required length of time without deformation.

SUMMARY OF THE INVENTION

It is an object of the present invention to provide a core for use in defining a passage in the casting of a component and which can withstand higher temperatures during casting without deformation than has been the case hitherto, and which can, if desired be produced in a variety of non-linear configurations.

In accordance with the present invention a core for use in defining a passage in a component to be cast comprises a hollow member of leachable ceramic refractory material, and a ceramic support member of material of greater refractoriness than that of said hollow member, said support member being located within said hollow member and extending at least partially within said hollow member with a slight clearance from the inner wall thereof at the operating temperature of the core.

In a preferred form of the invention the core is designed to produce a non-linear passage in the component to be cast, the passage having at least two straight portions interconnected by a bend. To achieve this the hollow member, which is made of the weaker ceramic material, is bent, and the support member comprises at least two parts which are straight, and are inserted into the straight portions of the hollow member from opposite ends thereof.

Also according to the present invention there is provided a method of casting a hollow component, comprising the steps of:

making a mold having a casting cavity the shape of the component to be cast, locating within the casting cavity a core which itself comprises a hollow member of leachable ceramic refractory material and a ceramic support member of material of greater refractoriness than that of the hollow member, the support member being located within the hollow member and extending at least partially within said hollow member with a slight clearance from the inner wall thereof at the operating temperature of the core, filling the mold with molten metal and allowing the metal to solidify, removing the support member from the hollow member of the core, and, leaching the hollow member from the solidified metal of the component.

In a preferred method according to the invention the hollow component to be cast has a non-linear hole extending therethrough, and the core is made by providing the hollow member with one or more bends therein, between two or more straight portions, and locating straight rods of the support member within the straight portions.

BRIEF DESCRIPTION OF THE DRAWINGS

Four alternative cores and one method in accordance with the invention will now be described, by way of example only, with reference to the accompanying drawings in which.

DETAILED DESCRIPTION

Figure 1:
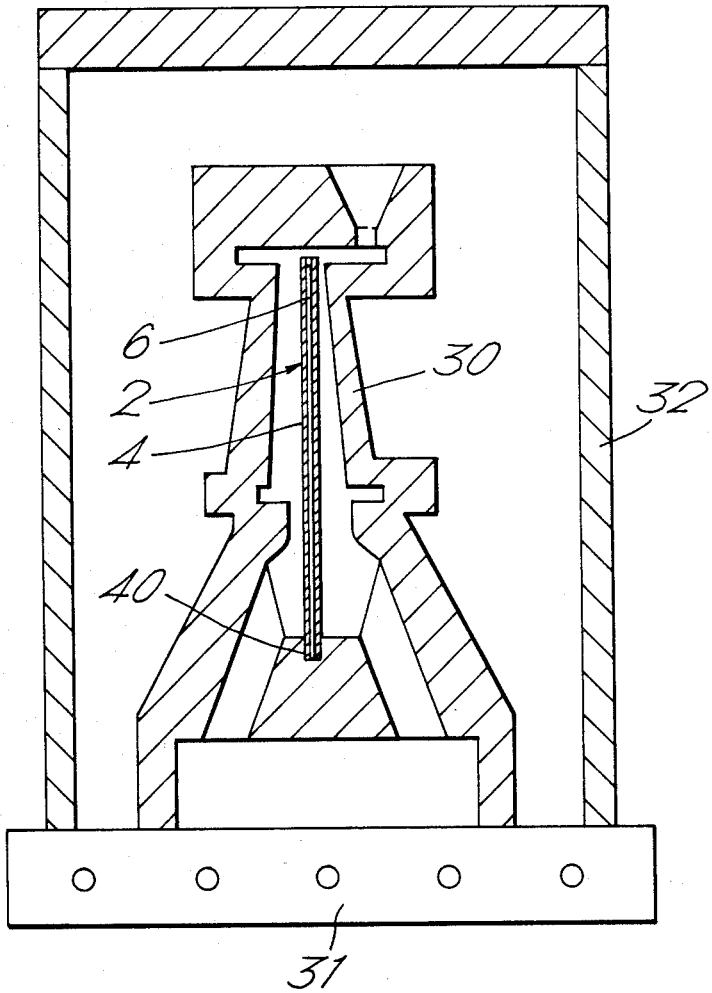
FIG. 1 shows a core of the present invention positioned in a mold in a furnace (shown diagrammatically) for producing a directionally solidified blade for a gas turbine engine having a cooling air passage therein.

Referring first to FIG. 1 there is shown a mold 30 for casting a hollow turbine blade or vane in a nickel-based superalloy material for a gas turbine engine. Positioned within the mold 30 and attached at one end 40 is a core 2 having an outer core member 4 which is of straight tubular form and is made of silica. The mold is positioned on a cooled chill plate 31 ready for inclusion in a furnace (shown diagrammatically at 32) adapted for casting the blade in a directionally solidified manner.

In the furnace 32 the mold is pre-heated to a temperature above that of the melting temperature of the metal to be cast to establish a temperature gradient along the mould. After pouring, the chill block causes solidification of the molten metal from the bottom of the mold upwards and this process is continued by maintaining the metal ahead of the solidification front molten while continuing to cool the mold from the bottom end only. This process, and a modification of it which involves the use of selecting a single crystal to grow into the upper part of the mold, are now well known and are not therefore described in detail.

Located in the bore of the tubular silica member 4 with a slidably close fit is a cylindrical support member 6 made of alumina. The alumina support member extends substantially all the way along the tubular silica member 4.

Typically, the tubular silica member 4 has an external diameter of approximately 0.07–0.10 inches and internal diameter of approximately 0.045 inches, and the cylindrical alumina support member 6 has a diameter of approximately 0.04 inches.

The internal diameter of the silica tube, and the external diameter of the alumina support are pre-selected to ensure that, taking into account the greater coefficient of thermal expansion of the Alumina support, there will still be a slight clearance e.g. of the order of 0.0005 to 0.001 in between the alumina support and the silica tube at the casting temperature to be used. This prevents bursting of the silica tube by the alumina support.

The core may be printed into the ceramic as shown at 40 by conventional methods using a polystyrene paint which allows for differential thermal expansion between the silica and the mold material. The alumina rod may be made to protrude beyond the end of the silica and to be printed into the ceramic as well, but alternatively may be left free within the silica tube, in which case the silica tube is closed at its free end to prevent escape of the alumina rod. Apart from the radial clearance between the Alumina rod and the Silica tube an end clearance must also then be allowed.

Figure 2:
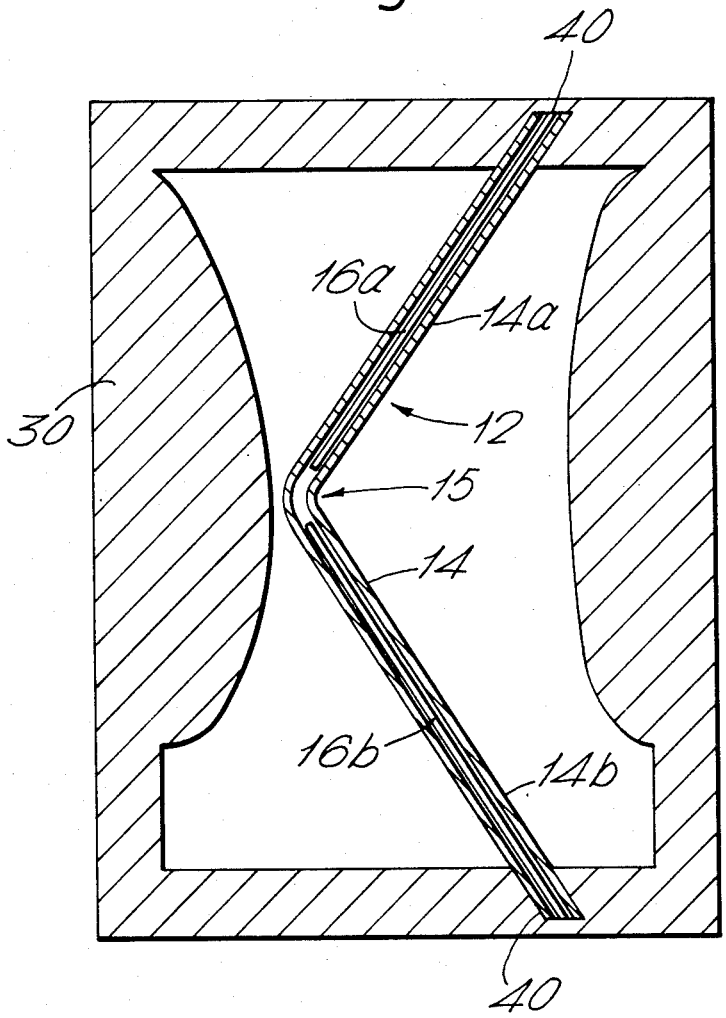
FIGS. 2, 3 and 4 show cross-sectional views of respectively second, third and fourth alternative cores in accordance with the invention, inserted in the mould of FIG. 1 (shown only diagrammatically) and, FIG. 5 shows a cross-section through a hollow gas turbine engine rotor blade illustrating a cast-in nonlinear passage.

Referring now to FIG. 2, an alternative second core 12 is shown for the mold 30 and which is shaped for defining a non-radial cooling air passage in the turbine blade or vane. The core 12 includes an outer core member 14 which is of tubular form, is made of silica and has two straight portions 14*a*,14*b* joined via a bend 15. Located in the bores of the straight portions 14*a*, 14*b* of the tubular silica member 14 with slidably close fits are cylindrical support members 16*a*,16*b* made of alumina. The alumina support members 16*a*,16*b* extend from opposite ends of the tubular silica member 14 substantially up to the bend 15.

Typically, the tubular silica member 14 and the cylindrical alumina support members 16*a* and 16*b* are of the same diameters as in the first core 2.

Figure 3:
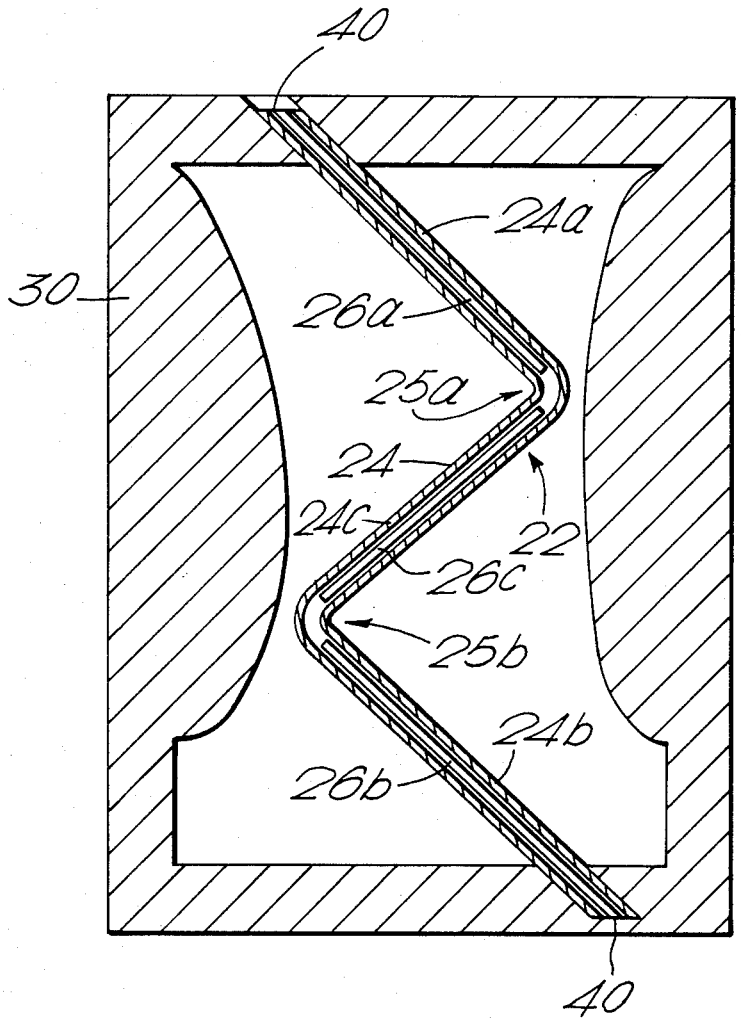

Referring now to FIG. 3, an alternative, third core 22 is shown for the mold 30 and which is shaped for defining a more complex non-radial cooling air passage in the turbine blade or vane. The core 22 includes an outer core member 24 which is of tubular form, is made of silica and has three straight portions 24*a*,24*b*,24*c* joined via bends 25*a*,25*b*. Located in the bores of the straight portions 24*a*,24*b*,24*c* of the tubular silica member 24 with slidably close fits are cylindrical support members 26*a*,26*b*,26*c* made of alumina. The alumina support members 26*a*,26*b* extend from opposite ends of the tubular silica member 24 substantially up to the bends 25*a* and 25*b* respectively and the alumina support member 26*c* extends substantially all the way between the bends 25*a* and 25*b*. The core 22 may be made by inserting into a straight tubular silica core the alumina support members 26*a*,26*b*,26*c*, heating the silica at the positions of the bends 25*a*,25*b* and forming the bends. In this way the alumina support members 26*a*,26*b*,26*c* maintain the remainder of the silica core straight and help to produce tight bends in the silica core.

Typically, the tubular silica member 24 and the cylindrical alumina support members 26*a*,26*b* and 26*c* are of the same diameters as in the first core 2 and the second core 12.

In the cases of the cores as shown in FIGS. 2 and 3 the straight portions of the cores are printed into the ceramic of the mould at each end, but allowance has to be made for longitudinal expansion of the Alumina rods relative to the silica tubes. The alumina rods thus extend as close to the bend as possible but are arranged such that under maximum operating temperature, the alumina rods do not jam into the bends.

Figure 4:
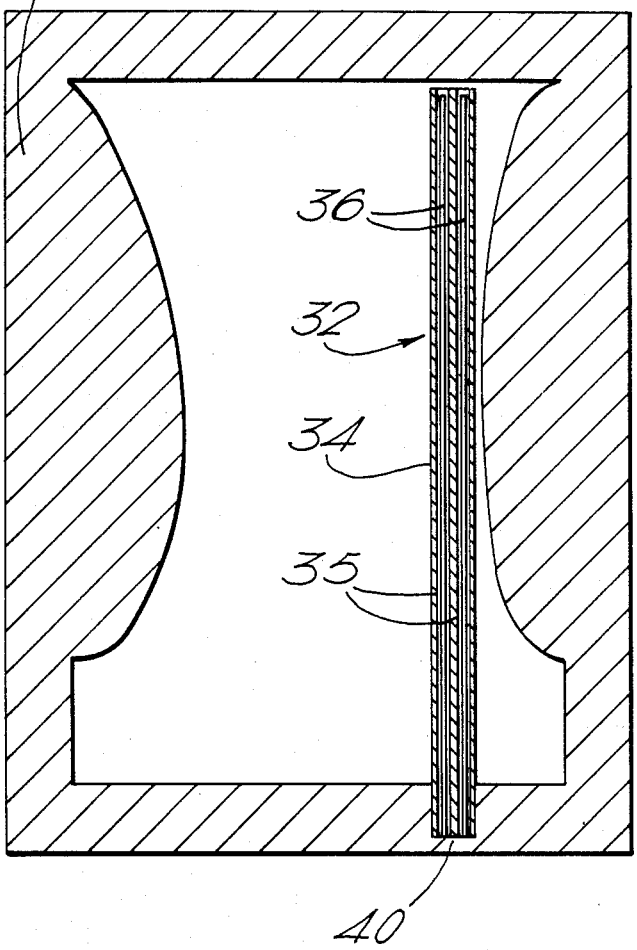

Referring now to FIG. 4, an alternative, fourth core 32 is shown for the mould 30 which is similar to the first core 2 for defining a straight cooling air passage in a blade or vane. Core 32 includes an outer core member 34 which is of straight tubular form having an elliptical cross-section and being provided internally with two spaced cylindrical bores 35 extending in parallel therealong. The tubular core member 34 is made of silica. Located in each of the bores 35 with a slidably close fit is a cylindrical support member 36 made of alumina. Each Alumina support member 36 extends substantially all the way along the tubular silica member 34.

Typically, the elliptically cross-sectioned tubular silica member 34 has a major axis of approximately 0.13 inches and a minor axis of approximately 0.036 inches, the bores 35 have a diameter of approximately 0.025 inches and the cylindrical alumina support members have a diameter of approximately 0.02 inches.

In use a core 2,12,22 or 32 is inserted into the mold 30 which is shaped to produce a gas turbine engine blade or vane. The mold 30 may be made in conventional manner by the lost wax process, or by a transfer molding method. The core is attached at one or both ends to the mold 30 in a joint 40 which accomodates thermal expansion between the core and the mold and holds the support member or members in the bore or bores of the tubular silica member. In the case of the first and fourth cores 2 and 32 it has been found sufficient with cores as much as twelve inches long to attach the core at one end only, but in the cases of the second and third cores 12 and 22 it may be desirable to attach the core at both ends. The mold 30 is then filled with molten nickel superalloy of a desired composition and allowed to cool, and the cooled blade or vane (not shown) is removed from the mould.

In the case of the first, second and fourth cores 2,12 and 32, the support member 6, the support members 16*a*,16*b* and the support members 35,36 respectively are then removed by simply sliding them out from their respective tubular silica members 4,14 and 34, and the tubular silica member is then leached away in known manner to leave the blade with its cooling air passage. In the case of the third core 22 the support members 26*a* and 26*b* are slid out from their respective ends of the tubular silica member 24, leaving trapped in the portion 24*c* thereof the support member 26*c*. The tubular silica member 24 is then leached away in known manner, leaving the remaining support member 26*c* trapped in the portion 24*c*, but now exposed on all sides. The exposed remaining support member 26*c* is finally readily leached away to leave the blade with its cooling air passage. This leaching out of alumina may conveniently be effected by the method of Patent Co-operation Treaty application No. PCT/GB81/00216, published as International Publication No. WO82/01144, which is herein incorporated by reference.

It will be appreciated that although in the above examples the outer core members are all of tubular form, the invention is not limited to such forms and is applicable to hollow cores of various shapes and configurations.

It will also be appreciated that although in the above examples support members are shown extending from the ends of outer core members, the support members may be enclosed within the outer core members.

The size of the clearance between the support member and the inner wall of the tubular member determines the amount by which the silica core can bend during the casting process. Thus by maintaining the clearance, at the high pouring temperature at a minimum of say 0.001 inches, very accurately positioned cooling passages can be produced.

The present invention makes possible the casting of such components as blades and vanes for gas turbine engines in superalloy materials using directional solidification techniques to produce columnar grained or single crystal components and having accurately defined, radially extending cooling passages which may extend through one end only of the blade or vane.

Figure 5:
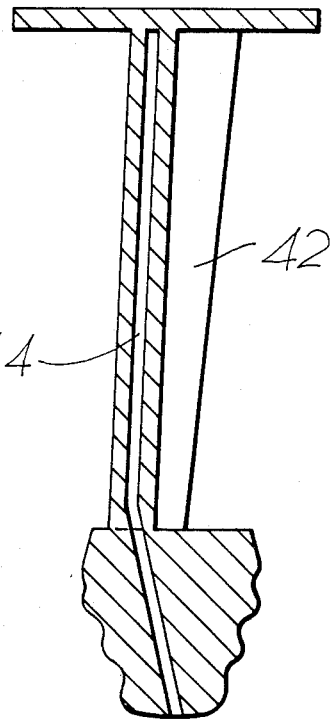

The present invention also makes possible the casting of such blades or vanes having cooling passages 44 containing bends which, as described earlier in the specification were believed to be unobtainable in a practical, cost effective manner (see Blade 42, FIG. 5).

Materials other than those described may be used for the core. The outer hollow member must be leachable from the cast metal and must be deformable where a non-linear core is to be made. While silica is preferred, however, some of the glass ceramics may be used. The inner support material must be rigid and retain its strength beyond 1500° C. for casting directionally solidified components. It need not be leachable but must not react with the outer hollow member so that it retains its freedom to slide under relative thermal expansions. In addition to alumina, zirconia or silicon nitride may be used.

Throughout this specification the terms "superalloy" or "nickel-based superalloy" should be taken to comprise those nickel-based or cobalt-based alloys currently used for the production of gas turbine engine blades and vanes and future derivatives thereof, many examples of which are available on the market including those alloys sold under the trade names MARM 200, and MARM 002 by Martin Metals Co., and IN100 sold by International Nickel Co.

We claim:

1. A method of casting a nickel- or cobalt-based superalloy component comprising the steps of:

(a) making a mold having a casting cavity in the shape of the component to be cast;

(b) locating a core within said casting cavity, said core comprising:

(i) a hollow member, said hollow member comprising two straight leachable ceramic refractory material portions interconnected by a bend; and, (ii) a ceramic support member, said ceramic support member comprising material of greater refractoriness than said material of said hollow member, wherein said support member comprises two straight portions extending into said hollow member from opposite ends thereof and terminating adjacent said bend, and wherein said hollow member has a larger inside diameter than the diameter of said support member at the operating temperature of the core;

(c) filling the mold with molten superalloy component material and allowing the superalloy component material to solidify; and, (d) removing the core from the component by withdrawing said support member portions from opposite ends of said hollow member and subsequently leaching said hollow member from the component.

2. A method of casting a nickel- or cobalt-based superalloy component comprising the steps of:

(a) making a mold having a casting cavity in the shape of the component to be cast;

(b) locating a core within said casting cavity, said core comprising:

(i) a hollow member, said hollow member comprising at least three straight leachable ceramic refractory material portions, each of said straight portions being interconnected with an adjacent straight portion by a bend; and, (ii) a ceramic support member, said ceramic support member comprising material of greater refractoriness than said material of said hollow member, wherein said support member comprises at least three straight portions, one extending within each of said straight portions of said hollow member and terminating adjacent said bends, and wherein said hollow member has a larger inside diameter than the diameter of said support member at the operating temperature of the core;

(c) filling the mold with molten superalloy component material and allowing the superalloy component material to solidify;

(d) removing the core from the component by:

(i) withdrawing from the opposite ends of said hollow member any accessible portions of said support member;

(ii) leaching said hollow member from the component; and (iii) leaching the remaining portions of said support member from the component.

3. A method of casting a component according to claim 1, wherein the molten component material is solidified by cooling the molten material at one end of the component to produce a directionally solidified component.

4. A method of casting a component according to claim 3 wherein the component comprises a gas turbine engine blade or vane in a superalloy material having a columnar grained structure.

5. A method of casting a component according to claim 4 wherein the component comprises a single crystal gas turbine engine blade or vane in a superalloy material.

6. A method of casting a component according to claim 1, wherein said hollow member of said core consists essentially of silica.

7. A method of casting a component according to claim 1, wherein said support member of said core consists essentially of alumina.

8. A mold for casting nickel- or cobalt-based superalloy, said mold comprising a core for defining a passage in a nickel- or cobalt-based superalloy casting component, said core comprising:

(a) a hollow member, said hollow member comprising leachable ceramic refractory material, wherein said hollow member comprises two straight portions interconnected by a bend; and, (b) a ceramic support member, said ceramic support member comprising material of greater refractoriness than said material of said hollow member, wherein said ceramic support member comprises two straight portions extending into opposite ends of said hollow member and terminating adjacent said bend; and wherein said hollow member has a larger inside diameter than the diameter of said support member at the operating temperature of the core.

9. A mold for casting nickel - or cobalt-based superalloy, said mold comprising a core for defining a passage in a nickel- or cobalt-based superalloy cast component, said core comprising:

(a) a hollow member, said hollow member comprising leachable ceramic refractory material, wherein said hollow member comprises at least three straight portions, each of said straight portions being interconnected with an adjacent straight portion by a bend; and, (b) a ceramic support member, said ceramic support member comprising material of greater refractoriness than said material of said hollow member, wherein said support member comprises at least three straight portions, one extending within each of said straight portions of said hollow member and terminating adjacent said bends; and wherein said hollow member has a larger inside diameter than the diameter of said support member at the operating temperature of the core.

10. A core according to claim 8 wherein said hollow member consists essentially of silica.

11. A core according to claim 8 wherein said support member consists essentially of alumina.

* * * * *